US012247406B2

(12) United States Patent
Reiter et al.

(10) Patent No.: US 12,247,406 B2
(45) Date of Patent: Mar. 11, 2025

(54) PANEL, IN PARTICULAR FLOOR PANEL, HAVING SEALING FUNCTION, AND PANEL SYSTEM

(71) Applicant: Fritz Egger GmbH & Co. OG, St. Johann in Tirol (AT)

(72) Inventors: Bruno Reiter, St. Johann in Tirol (AT); Tobias Holz, Wismar (DE)

(73) Assignee: Fritz Egger GmbH & Co. OG, St. Johann in Tirol (AT)

( * ) Notice: Subject to any disclaimer, the term of this patent is extended or adjusted under 35 U.S.C. 154(b) by 0 days.

(21) Appl. No.: 18/684,770

(22) PCT Filed: Aug. 18, 2022

(86) PCT No.: PCT/EP2022/073047
§ 371 (c)(1),
(2) Date: Feb. 19, 2024

(87) PCT Pub. No.: WO2023/025645
PCT Pub. Date: Mar. 2, 2023

(65) Prior Publication Data

US 2024/0328171 A1 Oct. 3, 2024

(30) Foreign Application Priority Data

Aug. 23, 2021 (EP) ..... 21192565

(51) Int. Cl.
*E04F 15/00* (2006.01)
*E04F 15/02* (2006.01)
*E04F 15/10* (2006.01)

(52) U.S. Cl.
CPC ..... *E04F 15/02038* (2013.01); *E04F 15/10* (2013.01); *E04F 2201/0107* (2013.01)

(58) Field of Classification Search
CPC ..... E04F 15/02033; E04F 15/02038; E04F 15/107; E04F 15/102; E04F 2201/042;
(Continued)

(56) References Cited

U.S. PATENT DOCUMENTS 6,766,622 B1 * 7/2004 Thiers ..... E04F 15/04 144/380
7,836,655 B2 * 11/2010 Chen ..... B27M 3/0053 52/592.1

(Continued)

FOREIGN PATENT DOCUMENTS

DE 102014106492 A1 11/2015
EP 3581732 A1 12/2019

(Continued)

*Primary Examiner* — Chi Q Nguyen
(74) *Attorney, Agent, or Firm* — The Webb Law Firm

(57) ABSTRACT

Provided is a panel, in particular floor panel, with an upside, with a underside, with a first side edge, with a second side edge arranged opposite the first side edge, with a first locking element formed on the first side edge, with a second locking element formed on the second side edge. The first locking element and the second locking element are designed to correspond to one another, with a first bearing surface formed on the first side edge. The first abutment surface adjoins the upside, and with a second abutment surface formed on the second side edge. The second abutment surface adjoins the upside, in which the technical problem of preventing moisture and dirt from penetrating between the connected panels is solved.

6 Claims, 2 Drawing Sheets

(58) Field of Classification Search
CPC ..... E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138; E04F 15/10
See application file for complete search history.

(56) References Cited

U.S. PATENT DOCUMENTS

| | | | | |
|---|---|---|---|---|
| 8,375,672 | B2 * | 2/2013 | Hannig | E04F 15/02038 52/591.1 |
| 8,720,150 | B2 * | 5/2014 | Hannig | E04F 13/0894 52/592.1 |
| 8,756,899 | B2 * | 6/2014 | Nilsson | E04F 15/105 52/592.1 |
| 10,858,846 | B2 | 12/2020 | Loebel | |
| 11,230,846 | B2 | 1/2022 | Hannig et al. | |
| 11,421,425 | B2 * | 8/2022 | Markovski | E04F 15/02038 |
| 11,608,646 | B2 * | 3/2023 | Schäfers | E04F 15/102 |
| 2008/0256890 | A1 | 10/2008 | Pervan et al. | |
| 2011/0138722 | A1 * | 6/2011 | Hannig | E04F 15/02033 52/309.1 |
| 2013/0192158 | A1 * | 8/2013 | Cappelle | B32B 7/12 52/588.1 |
| 2017/0016235 | A1 * | 1/2017 | Hannig | E04F 15/02033 |
| 2020/0232226 | A1 * | 7/2020 | De Rick | E04F 15/107 |
| 2020/0277796 | A1 * | 9/2020 | De Rick | E04F 15/02038 |
| 2022/0205253 | A1 | 6/2022 | Zorn | |

FOREIGN PATENT DOCUMENTS

| | | | |
|---|---|---|---|
| EP | 3626908 | A1 | 3/2020 |
| EP | 3708739 | B1 | 2/2021 |
| WO | 2010012116 | A1 | 2/2010 |

* cited by examiner

PANEL, IN PARTICULAR FLOOR PANEL, HAVING SEALING FUNCTION, AND PANEL SYSTEM

CROSS-REFERENCE TO RELATED APPLICATIONS

This application is the United States national phase of International Patent Application No. PCT/EP2022/073047 filed Aug. 18, 2022, and claims priority to European Patent Application No. 21192565.6 filed Aug. 23, 2021, the disclosures of which are hereby incorporated by reference in their entireties.

BACKGROUND OF THE INVENTION

Field of the Invention

The invention relates to a panel, in particular a floor panel, having a panel forming a core, having an upside, having a underside, having a first side edge, having a second side edge arranged opposite the first side edge, having a first locking element formed on the first side edge, having a second locking element formed on the second side edge, the first locking member and the second locking member being designed to correspond to each other, a first abutment surface formed on said first side edge, said first abutment surface being adjacent to the upside, and a second abutment surface formed on said second side edge, the second abutment surface being adjacent to the upside, wherein the material of the side edges corresponds to the core material of the panel. The invention also relates to a system comprising a plurality of panels.

Description of Related Art

It is known from the prior art to mechanically connect individual panels with the help of interlocking locking elements to form a flat whole, so that it is possible to lay the panels without adhesives or additional mechanical fastening elements, e.g. screws or nails. In particular, this results in the advantage that the panels can be laid and thus removed again without gluing.

The panel is preferably used as a flooring panel and is preferably made of laminate flooring panels of a wood-based material. A panel of a laminate flooring system consists of a core of an HDF or MDF board or of a chipboard, which are provided with an upper laminate coating and, if necessary, with a backing layer. Plastics and plastic-wood material mixtures can also be used as materials. However, the panels can also be used for other applications, for example as wall or ceiling panels.

The mechanical locking elements, also called mechanical locking profile or just profile, secure the interconnected panels on the one hand in a direction transverse to the connecting edge, in the horizontal direction in the case of floor panels, so that gap formation due to drifting apart is avoided. On the other hand, the locking elements secure the panels in a direction perpendicular to the upsides, in a vertical direction in the case of floor panels, to prevent the formation of an offset to each other. This is therefore also referred to as horizontal and vertical interlocking. For this purpose, the two side edges are provided with profiles corresponding to each other.

The locking elements come into contact with each other for the horizontal locking of the first side edge of a first panel with the locking surfaces of the horizontal locking of the second side edge of a second panel. Due to the contact and the subsequently exerted pressure, at least one element of the joint is bent during the process of joining, so that a further movement until the final joining results in the element engaging, i.e. bending back. Therefore, a mechanical resistance has to be overcome in each of the connections. The connections are therefore also called latching or snap connections. A very precise fit between the elements is important, both for the vertical locking by tongue and groove and for the horizontal connection.

The movement carried out when joining the two side edges of floor panels can basically have both horizontal and vertical components. There are side edges that snap together with a predominantly horizontal movement, so-called snap profiles. Furthermore, profiles are known that can be connected to each other by an angular movement, so-called angle profiles. In this case, side edges can have profiles that can be connected to each other both with a horizontal movement and by an angular movement.

In addition, panels are known with side edges that are engaged with each other by a substantially vertical movement. This allows each new panel to be laid to be engaged with already laid panels along at least one pair of side edges by placing the new panel with the corresponding side edges above the side edges of the already laid panels. This is then locked in place by pressure applied from above. Such a profile is also called a fold-down profile.

In a preferred combination of side edge profiles, the two long side edges are fitted with an angle profile and the two short side edges with a fold-down profile. When installing the floor panels, the panels are joined together in rows along the long and short side edges.

When a new panel is laid, the long side edge of the new panel is first brought into partial engagement with long side edges of an already laid row of panels, holding the new panel at an angle of attachment. At the same time, the new panel is placed so that the short side edge of the new panel is substantially vertically aligned with the short side edge of a panel already laid in the new row. The new panel is then swung down, causing the locking elements of the angle profiles along the long side edges on the one hand and the locking elements of the fold-down profiles along the short side edges on the other hand to engage and lock together.

All designs have in common that in the connected state there are gaps between the panels, which are neither visually nor haptically perceptible to an observer, but through which moisture or dirt can get between the panels. The penetration of liquid is particularly problematic, as the panels, especially wooden panels, can increase in volume at least in sections due to the penetration of moisture. The increase in volume, at least in sections, usually also referred to as swelling, can lead to drifting apart or the formation of a horizontal and/or vertical offset between the panels, which has a negative effect on the appearance, abrasion resistance and service life of the panels. This problem is addressed in various ways in the prior art.

A profile of a laminate flooring panel is known from EP 3 708 739 B1, in which two joining surfaces are arranged on the side edges of the panels, which lie against each other in a joined state of two panels. The joining surfaces have an inclined course relative to the upside of the panels, so that in the joined state a line pressure is created in the contact area of the joining surfaces, which serves to seal the joint.

In contrast, a profile is known from EP 3 626 908 A1, in which at least one swelling element is provided in the area of the profile to seal the connection of two panels. This swelling element consists of a material that has a large increase in volume due to moisture. If moisture penetrates into the gap between the panels, the swelling element expands in such a way that the connection is protected against further penetration of moisture below the swelling element.

A profile is known from EP 3 581 732 A1, which has a sealing groove on a first side edge and a corresponding sealing strip on a second side edge for sealing the gaps between two interconnected panels. In the joined state, the sealing strip engages in the sealing groove. The sealing strip and sealing groove are made of the material of the core of the panels, which is a swellable material. If moisture enters the gaps, the swelling of the material increases the sealing effect of the sealing strip-groove connection.

US 2008/0256890 A1 describes panels made of solid core materials with sections or layers of materials that are considerably more elastic than the core material, whereby sealing elements are formed in the elastic materials that engage with each other. The particular elasticity of the materials is exploited for the sealing function.

The disadvantage of the known solutions is that the measures that prevent or reduce the penetration of moisture or dirt require a special design of the profiles, for which only very small manufacturing tolerances can be permitted, or for which moisture must first penetrate between the profiles in order to obtain a sufficient sealing effect. The arrangement of additional surfaces also requires a fundamental change in the profile geometry. The known measures can in each case only be used with specially designed profiles, so that profiles known from the prior art, which use a locking mechanism that is proven in practice and in some cases widely used, cannot be supplemented with these measures.

SUMMARY OF THE INVENTION

The present invention is now based on the technical problem of further developing the above-mentioned panel in such a way that the penetration of moisture and dirt between the connected panels is prevented or further reduced.

According to the invention, the aforementioned technical problem is solved in a panel mentioned at the beginning in that a deformation element is arranged at least in sections on at least one of the abutment surfaces and in that a deformation section corresponding to the deformation element is provided on the other abutment surface.

The deforming element is thus itself made of the material of the plate forming the core and protrudes with respect to the abutment surface in the direction perpendicular to the abutment surface, while the other abutment surface with the deforming section is also made of the material of the plate forming the core and preferably runs flat and preferably has no depression. Thus, the deforming element and the deforming section correspond to each other to the extent that their positions along the abutment surfaces coincide in order to come into contact with each other when joining the profiles.

The panel offers the possibility, through the deformation element arranged on at least one side edge, to seal the joint between two panels to be laid at the abutment surfaces near the upsides against the penetration of moisture and dirt through the material of the panel forming the core itself.

In the locked state, which can also be referred to as the locking position, the pre-tension of a part of a locking element is used to seal the connection between two panels against the ingress of moisture and dirt by using the pre-tension to bring the deformation element on the first abutment surface of the first side edge into contact with the opposite second abutment surface on the second side edge.

The deformation element and the deformation section of the opposite abutment surface, with which the deformation element is in contact at least in sections, are elastically and/or plastically deformed by the contacting and pressing. The area in which the deformation element and the deformation section are in contact can also be referred to as an additional sealing location or as a sealing line. Due to the plastic deformation and the surface pressure caused by the contact, the penetration of moisture or dirt below the sealing point can be reduced as far as possible, preferably prevented. The deformation element and the deformation section of the opposite abutment surface are plastically deformed to such an extent that there is as small a gap as possible, preferably no gap, between the two abutment surfaces.

The first abutment surface and the second abutment surface are arranged in the area of the upside of the panel or directly adjoin the upside and run essentially perpendicular to the upside. In the area of the edge between the upside and the abutment surface, it is alternatively also common to provide a bevel, so that a so-called V-groove is created in the joined state. In the context of the present description, the bevel is part of the upside, so that even in the case of a V-groove, the abutment surfaces are adjacent to the upside, in this case to the bevels.

Due to the position in the area of the upside, the connection, i.e. the contact between the first and the second abutment surface, is decisive for both the visual and haptic impression of the connection between the panels. Due to the position of the abutment surfaces in the area of the upside, this section of the connection between two panels is critical for the penetration of liquid or dirt between the panels. The two abutment surfaces are arranged ahead of the first and second locking elements in the direction of the underside of the panel, so that by arranging the deformation element in the area of the abutment surfaces, the sealing location is arranged ahead of the surfaces or surface sections of the first and second locking elements intended for locking. This effectively protects the locking mechanism from the penetration of moisture or dirt.

In addition, the sectional increase in density of the material of the deformation element and the deformation section caused by the deformation and by the surface pressure caused thereby reduces the tendency of the material to absorb liquid.

In a preferred manner, the deformation element can be used with almost any profile geometry known from the prior art, since almost all known geometries have a pair of abutment surfaces adjacent to the upside on which at least one deformation element can be formed and deformed in the locking state. Thus, the locking mechanism underlying the known profile geometry is not affected.

The use of the deformation element enables the creation of a sealing effect between two interlocked panels without requiring, for example, line pressure in the area of the upper sections of the abutment surfaces, which results in a high mechanical load on the panels in the area of the visible sides. Moreover, the usual manufacturing tolerances can be maintained in that deviations over the extension of the side edges can be compensated for as long as sufficient deformation of the deformation element and the deformation section of the opposite abutment surface can be ensured in the locking position. In a preferred manner, the sealing effect can thus be maintained over the entire extension of the side edge.

In a preferred manner, no use of swelling elements is necessary, which can lead to a change in the force ratios within the interlock due to swelling in the interlocking position of already laid panels, so that sometimes the interlocking mechanisms are partially made void and an offset between the connected panels can occur.

Further, the deformation element is formed from the material of the side edges so that the deformation element has the same material properties as the opposite abutment surface. This means that the degree of deformation in the deformation of the deformation element and the deformation section of the opposite abutment surface is essentially conditioned by the geometry of the deformation element.

In a further preferred embodiment of the panel, the deformation element is made in one piece with the first side edge and/or the second side edge. In this way, the deforming element is already manufactured during the production of the panel. The use of a separately manufactured deformation element that is connected to the panel in a production step downstream of the profile production can be omitted, which simplifies the production and makes it more cost-efficient.

Preferably, a distance between a distal end of the deformation element and the abutment surface in the direction perpendicular to the abutment surface is in the range of 0.02 to 0.1 mm. In a preferred manner, a sufficiently large deformation can be achieved in this size range to seal the connection between the panels against the penetration of moisture and dirt without the deformation element protruding too far that an abutment of the first and second abutment surfaces is prevented.

In a further embodiment of the panel, at least one further deformation element is arranged on the first abutment surface and/or on the second abutment surface. The further deformation element can be arranged on the same side edge or on the side edge opposite the side edge. The arrangement of a further deformation element enables a further improvement of the sealing effect.

The vertical positions of the deformation elements along the two abutment surfaces are preferably different so that their functions complement each other. Alternatively, however, one deformation element may correspond to a deformation section that also protrudes, in particular in the same way as the deformation element of the other abutment surface. In this case, two protruding elements on the abutment surfaces come into contact with each other and deform to form a sealing point.

In an advantageous embodiment, the deformation element has a substantially triangular cross-section. The triangular cross-section of the deformation element allows the deformation element to be used with panels whose locking mechanism has a comparatively low surface pressure within the locking mechanism, so that only a low force is available for deforming the deformation element or the deformation section that is in contact with the deformation element. Due to the substantially triangular cross-section, the deformation element can be easily deformed and, due to the resulting sharp configuration at the distal end, can penetrate into the opposite abutment surface with a small amount of force and in turn deform the deformation section there. Such a design is also advantageous if the panels are made of a comparatively hard or dense material, which generally allows little deformation or compression. The dimension of a pointed embodiment is predetermined and limited by the structure of the material of the panel. Coarse structures of the material allow less pointed structures than fine structures of the material.

In an advantageous embodiment of the panel, the deforming element has has an essentially trapezoidal cross-section, preferably with angles of 120° and a base length of approx. 0.4 mm. This design makes the deformation element particularly dimensionally stable, so that in the case of panels whose connection mechanism requires a comparatively large force, the deformation element is designed to be sufficiently resistant and results in sufficient pressure to seal the connection of the panels.

Further preferably, the deforming element has an essentially semicircular cross-section. This design is particularly advantageous for panels that have fold-down profiles. Due to the semi-circular cross-section of the deformation element, there is no risk of the deformation element being damaged, in particular kinked or sheared off, when the second panel is lowered.

Although the configuration of the first and second side edges of the panel has been described above, the panel may also have a third side edge and a fourth side edge which are arranged opposite each other and are substantially perpendicular to the first and second side edges and also have connecting profiles corresponding to each other. At least one deformation element and a deformation section can also be provided at the third side edge and the fourth side edge.

The technical problem is also solved by a system of a plurality of panels, characterised in that in a locking position, the first locking element on the first side edge of a second panel is in contact, at least in sections, with the second locking element formed on the second side edge of a first panel, that in the locking position, the first abutment surface on the first side edge of the second panel is in contact, at least in sections, with the second abutment surface on the second side edge of the first panel, that in the locking position the deforming element arranged on the first abutment surface of the first side edge of the second panel and/or the deforming element arranged on the second abutment surface of the second side edge of the first panel is in contact with the second abutment surface of the second side edge of the first panel and/or with the abutment surface of the first abutment surface of the first side edge of the second panel, and that the contact of the deforming element with the opposite abutment surface deforms the deforming element and the opposite deforming section at least in sections.

BRIEF DESCRIPTION OF THE DRAWINGS

In the following, the invention is explained by means of an embodiment example with reference to the drawing. In the drawings show FIG. 1 a second side edge of a first panel according to the invention and a first side edge of a second panel according to the invention arranged at a distance from the second side edge, FIG. 2 the side edges of the first and second panels shown in FIG. 1 in a locked position, FIG. 3 a detailed view of the locking position of the panels shown in FIG. 2.

DETAILED DESCRIPTION

Figure 1:
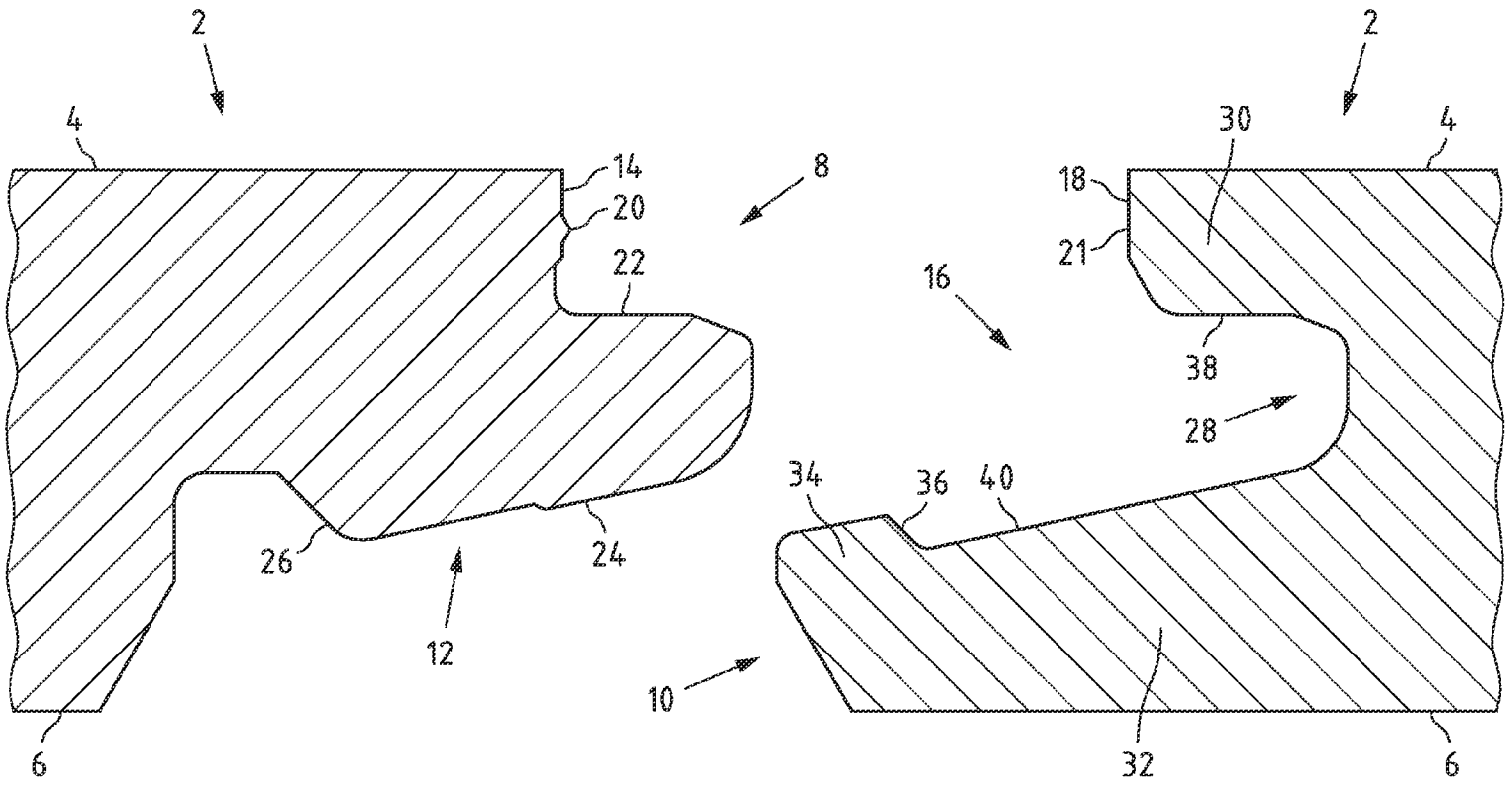

FIG. 1 shows two panels 2 according to the invention with an upside 4 and a underside 6 as well as with a first side edge 8 and a second side edge 10, which is arranged opposite the first side edge 8. A first locking element 12 is formed on the first side edge 8 and a first abutment surface 14 is formed in the area of the upside 4 of the panel 2.

A second locking element 16 corresponding to the first locking element 12 and a second abutment surface 18 in the area of the upside 4 are formed on the second side edge 10. Both abutment surfaces 14, 18 are bounded by the upside 4 in the direction of the upside 4, i.e. they adjoin the upside 4. In the direction of the underside 6, the first locking element 12 and the second locking element 16 are arranged below the first abutment surface 14 and the second abutment surface 18 respectively.

In the embodiment example shown, a deformation element 20 made in one piece with the first side edge 8 is arranged on the first abutment surface 14 between the end of the first abutment surface 14 facing the upside 4 and the end of the first abutment surface 14 facing the underside 6. Due to the one-piece design, the deformation element 20 is made of the material of the first side edge 8, wherein the material of the first side edge 8 corresponds to the core material of the panel 2. In this embodiment, the first abutment surface 14 can also be referred to as the base surface of the deformation element 20.

On the other abutment surface 18, a deformation section 21 corresponding to the deformation element 20 is provided, i.e. a material section of the side edge 10 which comes into contact with the deformation element 20 when the panels 2 are joined and is simultaneously deformed with the deformation element 20.

The deformation element 20 is configured such that a distal end of the deformation element 20 protrudes in a direction perpendicular to the first abutment surface 14 relative to the first abutment surface 14. The deformation element 20 shown has a substantially triangular cross-section, with a tip of the deformation element 20 constituting the distal end of the deformation element 20. The distal end of the deformation element protrudes in the direction perpendicular to the first abutment surface 14 in the range of 0.05 mm to 0.2 mm, in particular 0.08 m to 0.12 mm.

In the embodiment shown, the first locking element 12 is configured as a spring 12 at the first lateral edge 8 of the panel 2, the spring 12 having a spring upside 22, a spring underside 24 and a first locking surface 26 formed at the distal end of the spring 12.

The second locking element 16, arranged on the second lateral edge 10 of the panel 2 and corresponding to the first locking element 12, comprises a groove 28 delimited in the direction of the upside 4 by an upper lip 30, at the distal end of which the second abutment surface 18 is formed. In the direction of the underside 6, the groove 28 is delimited by a lower lip 32, the lower lip 32 projecting distally with respect to the upper lip 30, and a projection 34 is formed on the distal end of the lower lip 32, on which projection a second locking surface 36 facing the groove is arranged at the proximal end.

Figure 2:
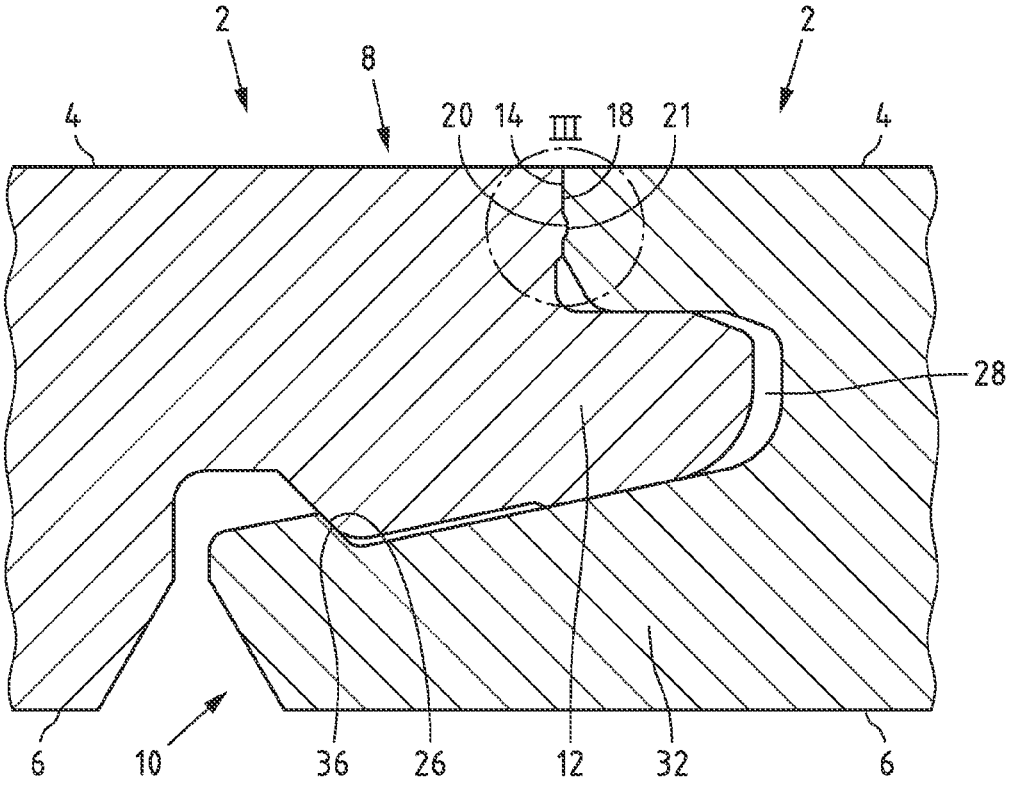

In the locking position shown in FIG. 2, the spring 12 is disposed on the first side edge 8 of the second panel 2 at least partially within the groove 28 on the second side edge 10 of the first panel 2, with a portion of the upside of the spring 22 in contact with a underside 38 bounding the upper lip 30 in the direction of the bottom 6 and the bottom of the spring 24 in contact with an upside 40 of the lower lip 32. As a result of the contact of the second locking surface 36 with the first locking surface 26, a bias of the lower lip 32 generated by the contact and by the corresponding configuration of the first connecting element 12 and the second connecting element 16 in the lower lip 32 pushes the spring 12 and thus the second panel 2 towards the first panel. The resulting contact force plastically deforms the deformation element 20 arranged on the first abutment surface 14 and the deformation section 21 of the second abutment surface 18 in contact with the deformation element 20 in such a way that the first abutment surface 14 is in contact with the second abutment surface 18 and no visually or haptically perceptible gap is formed between the first abutment surface 14 and the second abutment surface 18.

The deformation of the deformation element 20 as well as the deformation section 21 of the second abutment surface 18, which is in contact with the deformation element 20, causes a local compression of the material, resulting in a linear surface pressure in this area, which can also be referred to as a sealing area or sealing line. Due to the close contact or the deformation of the deformation element 20 and the deformation section 21, the connection between the first panel 2 and the second panel 2 is sealed so that no moisture or dirt can penetrate into the gap between the panels 2, 2 below the sealing point.

Figure 3:
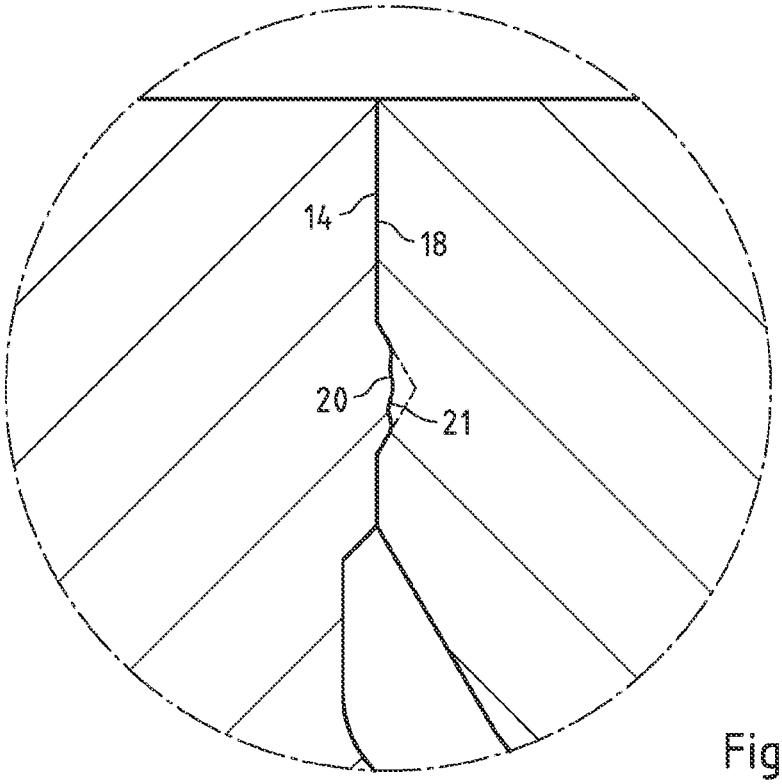

The deformation of the deformation element 20 and of the deformation section 21 of the second abutment surface 18 in contact with the deformation element 20 can be seen in the detailed view (III) of the sealing area shown in FIG. 3. The original outer contour of the deformation element 20 is shown by the dashed lines. It can be seen how the deformation element 20, although strongly deformed, has nevertheless penetrated the surface of the second abutment surface 18 and deformed the deformation section 21 due to the surface pressure. The deformation results in a compression of the material both within the deformation element 20 and the first abutment surface 14 and in the deformation section of the second abutment surface 18 that is in contact with the deformation element 20.

The invention claimed is:

1. A panel, especially a floor panel, comprising:
a plate forming a core;
an upside;
an underside;
a first side edge;
a second side edge arranged opposite the first side edge;
a first locking element formed on the first side edge;
a second locking element formed on the second side edge, wherein the first locking element and the second locking element are designed to correspond to each other;
a first abutment surface formed on the first side edge, the first abutment surface being adjacent to the upside; and
a second abutment surface formed on the second side edge, the second abutment surface being adjacent to the upside,
wherein the first locking element and the second locking element are able to establish a horizontal locking in a locking position, and
wherein the material of the side edges corresponds to a core material of the plate,
wherein
a deformation element is arranged at least in sections on at least one of the abutment surfaces, wherein the deformation element is formed from the material of the side edge, wherein the deformation element protrudes with respect to the at least one of the abutment surfaces,
a deformation section corresponding to the deformation element is provided on another abutment surface of the at least one of the abutment surfaces, wherein the deformation section runs flat with respect to the other abutment surface, and
the deformation element and the deformation section are able to be deformed at least partly in the locking position due to a contact of the deformation element with an opposite abutment surface.

2. The panel according to claim 1,
wherein
a distance between a distal end of the deformation element and the abutment surface in a direction perpendicular to the abutment surface is in a range of 0.02 to 0.1 mm.

3. The panel according to claim 1,
wherein
the deformation element has a substantially triangular cross-section.

4. The panel according to claim 1, wherein the deformation element has a substantially trapezoidal cross-section.

5. The panel according to claim 1,
wherein
the deformation element has a substantially semicircular cross-section.

6. A system of a plurality of panels according to claim 1,
wherein
in a locking position, the first locking element on the first side edge of a second panel is in contact, at least in sections, with the second locking element formed on the second side edge of a first panel,
in the locking position, the first abutment surface on the first side edge of the second panel is in contact, at least in sections, with the second abutment surface on the second side edge of the first panel,
in the locking position the deforming element arranged on the first abutment surface of the first side edge of the second panel and/or the deforming element arranged on the second abutment surface of the second side edge of the first panel is in contact with the second abutment surface of the second side edge of the first panel and/or with the abutment surface of the first abutment surface of the first side edge of the second panel, and
the contact of the deforming element with the opposite abutment surface deforms the deforming element and the opposite deforming section at least in sections.

* * * * *